US011287139B2

(12) United States Patent
Xu et al.

(10) Patent No.: US 11,287,139 B2
(45) Date of Patent: Mar. 29, 2022

(54) HEATING PLATE WITH COOKING OIL IGNITION PREVENTION FOR ELECTRIC COOKING APPARATUS

(71) Applicants: Haiyan DongHai Electric Appliances Co., Ltd., Jiaxing (CN); Yun Bai, Beijing (CN)

(72) Inventors: Jiedong Xu, Jiaxing (CN); Yun Bai, Beijing (CN)

(73) Assignee: HAIYAN DONGHAI ELECTRIC APPLIANCES CO., LTD., Jiaxing (CN)

( * ) Notice: Subject to any disclaimer, the term of this patent is extended or adjusted under 35 U.S.C. 154(b) by 282 days.

(21) Appl. No.: 16/220,723

(22) Filed: Dec. 14, 2018

(65) Prior Publication Data

US 2019/0186752 A1 Jun. 20, 2019

Related U.S. Application Data

(60) Provisional application No. 62/599,888, filed on Dec. 18, 2017.

(51) Int. Cl.

| | |
|---|---|
| ***H05B 3/68*** | (2006.01) |
| ***F24C 7/08*** | (2006.01) |
| ***H05B 1/02*** | (2006.01) |
| ***F24C 15/10*** | (2006.01) |

(52) U.S. Cl.

CPC ..... *F24C 7/083* (2013.01); *F24C 15/105* (2013.01); *H05B 1/0266* (2013.01)

(58) Field of Classification Search

CPC .... F24C 15/102; F24C 15/105; F24C 15/106; F24C 7/06; F24C 7/062; F24C 7/065; F24C 7/08; F24C 7/081; F24C 7/082; F24C 7/083; H05B 1/0252; H05B 1/0261; H05B 1/0266; H05B 3/742–748; H05B 3/76; H05B 3/68; H05B 3/681; H05B 3/683; H05B 3/685

See application file for complete search history.

(56) References Cited

U.S. PATENT DOCUMENTS 2,806,122 A * 9/1957 Thunander ..... G05D 23/1913 219/448.14
3,564,206 A * 2/1971 Lauck, III ..... G05D 23/1909 219/501
3,987,275 A * 10/1976 Hurko ..... H05B 3/748 219/451.1
4,241,289 A * 12/1980 Bowling ..... F24C 15/105 136/221

(Continued)

*Primary Examiner* — Sang Y Paik
(74) *Attorney, Agent, or Firm* — RatnerPrestia

(57) ABSTRACT

An electric heating plate for electric cooking apparatuses is provided with the capability to prevent unintended ignition of cooking oil. The heating plate includes an electric heating conductor as the heat source and a temperature controller electrically connected with the heating conductor, sensing the temperature of the cooking vessel, controlling the heating plate output power, and limiting the temperature of the cooking oil in the cooking vessel. With this heating plate, the electric cooking apparatus will be able to prevent cooking oil ignition during cooking, while the minimum cooking temperature for a daily cooking is still maintained.

15 Claims, 3 Drawing Sheets

(56) References Cited

U.S. PATENT DOCUMENTS

| | | | | | |
|---|---|---|---|---|---|
| 4,410,793 | A * | 10/1983 | Fischer | H05B 3/72 | 219/448.15 |
| 4,493,981 | A * | 1/1985 | Payne | F24C 15/106 | 219/448.12 |
| 7,189,949 | B1 * | 3/2007 | Bush | B41J 2/04563 | 219/216 |
| 9,220,130 | B1 * | 12/2015 | Smith | H05B 1/0266 | |

* cited by examiner

HEATING PLATE WITH COOKING OIL IGNITION PREVENTION FOR ELECTRIC COOKING APPARATUS

TECHNICAL FIELD

The invention relates to a heating plate with a temperature limiting control function, in particular to a temperature limiting control on the cooking vessel with a temperature controller, so that the maximum temperature of the cooking oil in the cooking vessel can be limited below the cooking oil ignition point during cooking, while the minimum cooking temperature for a daily cooking is still maintained.

BACKGROUND

In US and Canada, the leading cause of fires in the kitchen is unattended cooking. When people are cooking food in homes, student domes, retirement homes, hotel suites with kitchens and the like where, because of carelessness, forgetfulness, or lack of safe cooking training, the cooking vessel with cooking oil is left on the cooking apparatus's heating surface unattended, and it is possible to cause a fire by the fact that the temperature of the cooking vessel is much higher than the ignition point of the cooking oil, which based on experimentation is typically 360° C./680° F. to 400° C./752° F.

The cooking fire and smoke cause a large amount of preventable death, personal injury and property damage each year. Therefore, preventing cooking fire is important for individuals, housing management companies, insurance companies and fire departments.

The potential safety issue of this problem has been recognized gradually, and in the newly updated UL safety standard, for an electric cooking apparatus using a coil heating plate, it is required to pass UL858 60A, Coil Surface Unit Cooking Oil Ignition Test. According to UL858 60A testing requirement, under the rated heating power of the coil heating plate, a pan with cooking oil is placed on the heating plate and allowed to operate for 30 minutes without cooking oil ignition.

U.S. Pat. No. 8,723,085 to Callahan provides a temperature control method on a cast iron heating plate. The device is composed of a cast iron heating plate, heating wire, Magnesium oxide insulating layer, cover, a supporting frame, a thermostat. The device has a complex structure with a high manufacturing cost; in the meantime, the thermostat's fair performance and shorter lifetime limit the heating performance and lifespan of the heating plate.

U.S. Pat. No. 6,246,033 to Shah provides a temperature control method for a coil heating element. The method uses a control circuit and temperature probe to achieve temperature limiting control. However, the method needs to change the wiring of the original control circuit of the electric cooking apparatus, install the control circuit on the back of the apparatus, and modify the heating plate. Due to the complexity of whole modification, the installation must be completed by a trained and licensed technician.

U.S. Pat. No. 9,220,130 to Smith provides a temperature control method for a cooking apparatus with coil heating plates installed. In this method, a temperature sensing and control device is connected in series with the apparatus wiring and installed within the apparatus to measure the temperature under the heating plate and control the power on/off for the heating plate. This method can only be used on the specially designed and made cooking apparatus.

The electric heating plate or the cooking apparatus designed with the above patented technology has the function of heating surface temperature limiting control. Due to the high manufacturing cost, fair cooking performance, shorter lifespan, complex installation, or only applied to specially designed apparatus, etc., none of them has gained widespread acceptance.

In North America, approximately 60% of installed cooking apparatuses are electric powered. Those cooking apparatuses do not have the function of preventing the cooking oil ignition. There is an urgent need for a heating plate, which is able to prevent cooking oil ignition, low cost, long lifespan, and can be easily installed into electric cooking apparatus.

Features that distinguish the present invention from the background art will be apparent from the following disclosure, drawings and description of the invention presented below.

SUMMARY OF THE INVENTION

The invention provides an electric heating plate and a method with a temperature limiting control function, with which an electric apparatus is capable of preventing the cooking oil ignition during cooking while still maintaining the minimum cooking temperature for daily cooking performance. The plate composes an electric heating conductor and a temperature controller, which has a temperature transfer device (the device) and a control unit. The device touches the cooking vessel and transfers the temperature of the cooking vessel to the control unit, which electrically connects with the heating conductor of the heating plate. Comparing the transferred temperature with the predetermined upper/lower temperature limits, the control unit adjusts the output power of the heating plate, controls the temperature of the cooking vessel, thereby limits the cooking oil temperature in the cooking vessel.

Based on a large number of experiments, the temperature transfer model for the temperature transferring among the heating surface, the cooking vessel, the cooking oil, and the control unit can be established. The control unit's upper and lower temperature limits are determined based on the experimental temperature transfer model, which takes into account the temperature transfer device design and placement, the control unit type, the heating plate output power, the cooking vessel type, the cooking oil temperature ignition point, typically between 360° C./680° F. to 400° C./752° F., and the minimum temperature required by daily cooking, typically above the cooking boiling point, 250° C./482° F.

For a cooking under the rated power of the heating plate, when the temperature of the cooking oil in the cooking vessel approaches, but never reaches, the cooking oil ignition point, the temperature transferred from the cooking vessel to the control unit reaches the upper temperature limit, then the control unit reduces the output power of the heating plate, and the temperature of the cooking oil is limited below the oil ignition point; when the temperature of the cooking oil in the cooking vessel drops to the cooking oil boiling point, and the temperature transferred to the control unit reaches the lower temperature limit, the control unit increases the output power of the heating plate, hence increases temperature of the cooking oil to maintain the cooking temperature required by daily cooking. Accordingly, a controlled cycle of the temperature of the cooking oil and the power change of the heating plate is formed, and the temperature of the cooking oil is limited below the cooking oil ignition point, while still maintains a desired cooking performance.

DETAILED DESCRIPTION

Figure 1:
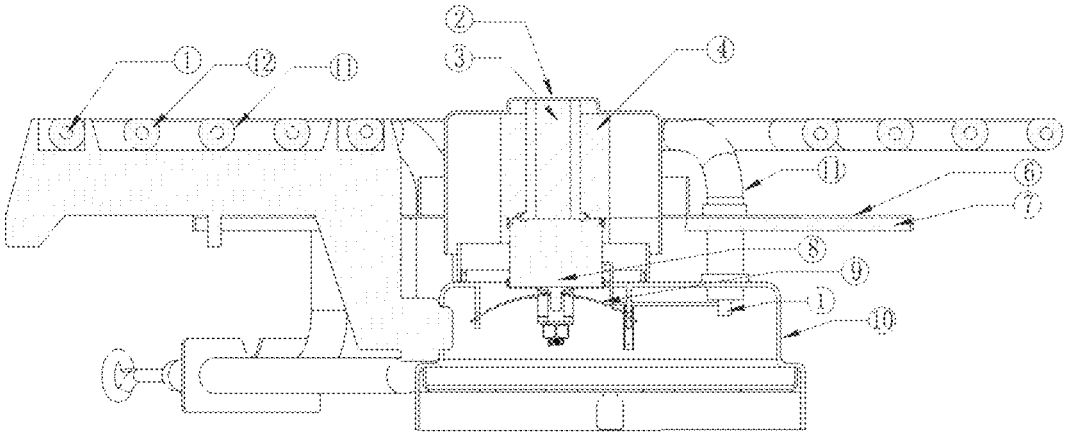
FIG. 1 is a cross-sectional view of one embodiment of the heating plate.
Figure 2:
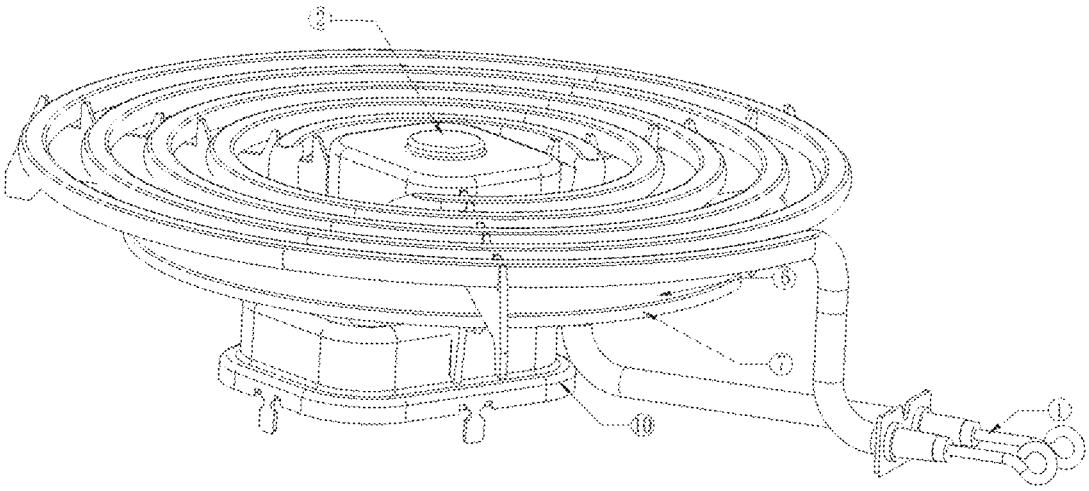
FIG. 2 is a top perspective view the of the heating plate shown in FIG. 1.

In one embodiment, as shown in FIG. 1 FIG. 2, the heating plate includes heating wire 1, which is in a metallic tube 11 and insulated by Magnesium Oxide powder 12, and a temperature controller composing a temperature transfer device 3 and a control unit 8 connected in series with the coil heating wire 1. The device is made of high thermal-conductivity metal, surrounded by the heat insulation layer 4, and covered by a metal cap 2. The device's lower end is mounted on the temperature sensing part of the control unit, while the control unit is mounted on an elastic mechanism 9, a metal spring leaf, under the plate, away from the heat source, the heating wire and the cooking vessel. Therefore, the control unit and the lower end of the device are in a cold area, in which the temperature is at least 70° C./158° F. lower than the cooking vessel bottom. The temperature controller and the device are raised by the metal spring leaf, wherein the top end of the device is higher than the plate surface. When a cooking vessel is placed on the heating plate, the cooking vessel bottom presses against the top end of the device, making a solid, direct contact between the device's top end and the bottom of the cooking vessel. During cooking, the device's top end heated by the cooking vessel bottom, the device's lower end in a cold area, and the other part of the device insulated by the heat insolation layer form a heat pipe effect, which ensures a highly efficient temperature transfer from the cooking vessel to the control unit.

A multi-layer heat insulation/reflection pad 6/7 is set between the control unit and the heating wire to reduce the air temperature around the control unit and the device's lower end, making the cold area cooler. The pad reflects the heat from the heating wire to the plate surface. This increases the power efficiency of the heating plate.

The table below shows an example of this embodiment, wherein the temperature controller includes the device, a 45 mm long, 16 mm diameter rod made of Aluminum 6061, and a control unit, Z3-250-200 thermostat made by DongLing. The controller is raised by a stainless-steel spring leaf, 40 mm×8 mm×0.2 mm, with two ends mounted on the bracket 10. The top end the device is 5 mm higher than the heating plate surface, and the control unit is 35 mm lower than the plate surface. The heating plate is 8" with a power rating of 2400 W. The heat insulation/reflection pad is a 1 mm thick, ø150 mm Aluminum disc 6 and 5 mm thick fiberglass insulation layer 7.

| Temperature in the cooking oil (° C.) | Temperature of the cooking vessel bottom (° C.) | Temperature transferred to the control unit (° C.) | Predetermined temperature limits for control unit (° C.) |
|---|---|---|---|
| 200 | 220 | 140 | |
| 250 | 275 | 200 | 200, Lower temperature limit |
| 285 | 305 | 225 | |
| 320 | 340 | 250 | 250, Upper temperature limit |

For a cooking under the rated power of the heating plate, when the temperature of the cooking oil approaches 320° C., whereby the temperature transferred to the control unit reaches the upper temperature limit, 250° C., the control unit turns off the power of the heating wire and causes the heating wire to stop generating heat; when the temperature of the cooking oil drops to 250° C., the temperature transferred to the control unit reaches to the lower temperature limit, 200° C., the control unit turns on the power of the heating wire causing the heating wire to generate heat. A controlled temperature cycle for the cooking oil in the cooking vessel is formed; the temperature of the cooking oil is limited below 320° C., which is below the cooking oil ignition point, and the minimum cooking oil temperature is kept above 250° C., the cooking oil boiling point, to maintain a desired cooking performance.

Figure 3:
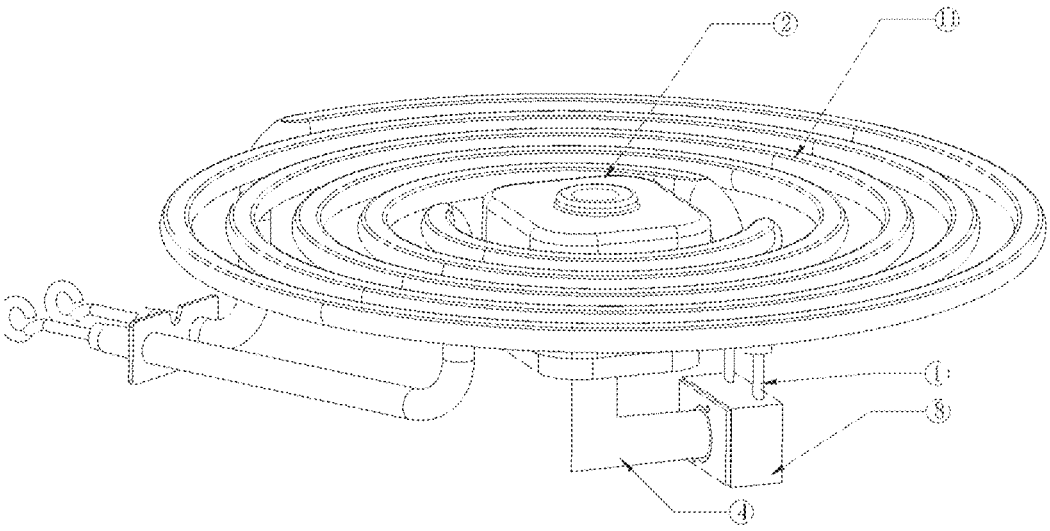
FIG. 3 is a top perspective view showing another embodiment of the heating plate.
Figure 4:
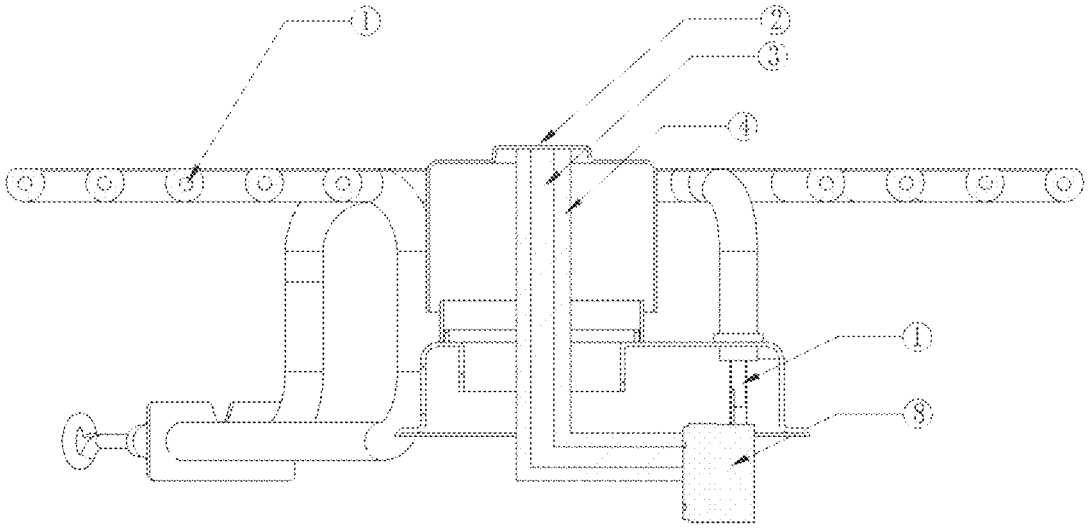
FIG. 4 is a cross-sectional view of the heating plate shown in FIG. 3.

In another embodiment, as shown in FIG. 3 and FIG. 4. whereby, a temperature controller composing the device 3 made of high thermal-conductivity metal, surrounded by the heat insulation layer 4, and covered by a metal cap 2. The device forms a L shape cantilever working as an elastic mechanism to push the top end of the device higher than the plate surface. The device's lower end is mounted on the temperature sensing part of the control unit 8, which is placed under the heating plate and away from the heating source, the heating wire and the cooking vessel. Therefore, the control unit and the lower end of the device are in a cold area. When a cooking vessel is placed on the heating plate, the cooking vessel presses against the top end of the device, making a solid, direct contact between the device's top end and the bottom of the cooking vessel. During cooking, the device's top end heated by the cooking vessel bottom, the device's lower end in a cold area, and the other part of the device insulated by the heat insolation layer form a heat pipe effect, which ensures a highly efficient temperature transfer from the cooking vessel to the control unit.

The table below shows an example for this embodiment, where the device is 60 mm long (45 mm vertical+15 mm horizontal), 6 mm diameter L shape cantilever made of Aluminum 5052, and covered by 5 mm thick fiberglass insulation. The control unit is a thermostat, DongLing Z3-225-210, and placed 35 mm lower than the plate surface. The heating plate is 8" with a power rating of 2400 W.

| Temperature in the cooking oil (° C.) | Temperature of the cooking vessel bottom (° C.) | Temperature transferred to the control unit (° C.) | Predetermined temperature limits for control unit (° C.) |
|---|---|---|---|
| 200 | 220 | 180 | |
| 250 | 265 | 210 | 210, Lower temperature limit |
| 285 | 310 | 190 | |
| 320 | 340 | 225 | 225, Upper temperature limit |

For a cooking under the rated power of the heating plate, the upper and lower limits of the control unit are accordingly set to control the bottom temperature of cooking vessel to maintain a desired cooking performance while not exceeding the cooking oil ignition temperature.

Figure 5:
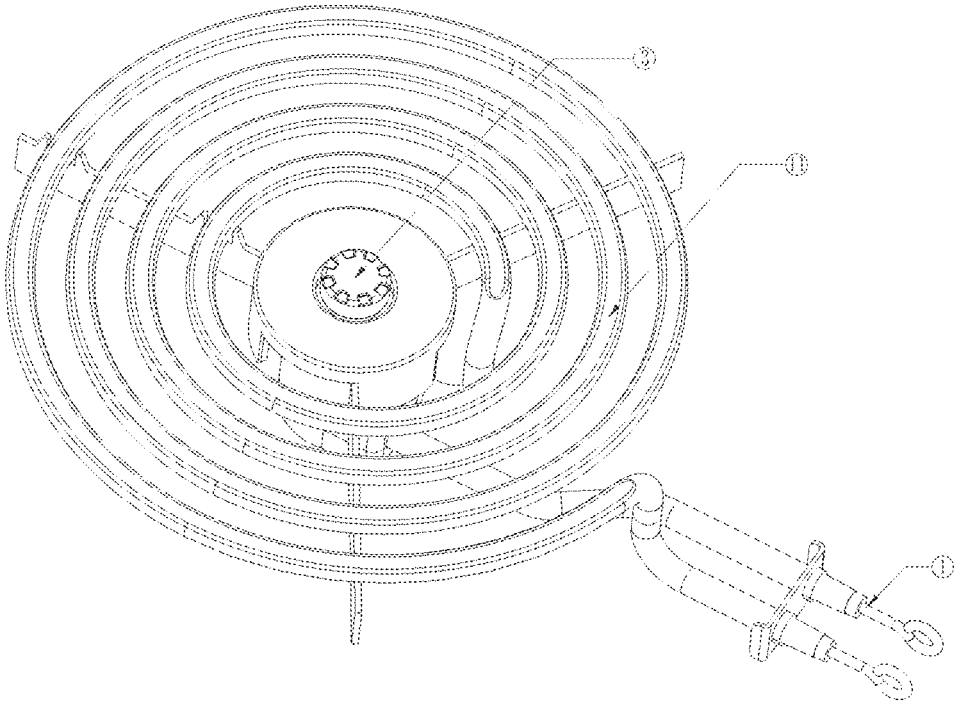
FIG. 5 is a top perspective view of an alternate embodiment of the heating plate.
Figure 6:
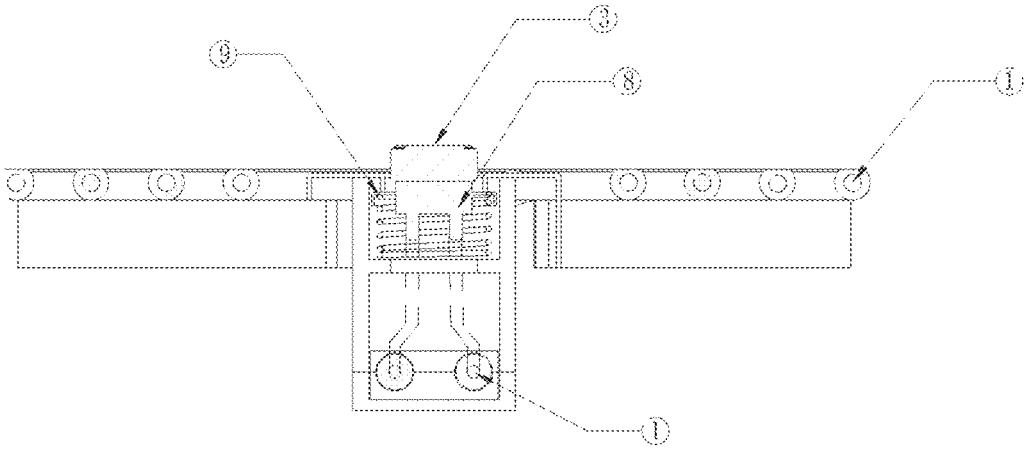
FIG. 6 is a cross-sectional view of the heating plate shown in FIG. 5.

In an alternate embodiment, as shown in FIG. 5 and FIG. 6, the temperature controller including a control unit 8 and a disc temperature transfer device 3. The lower end of device is mounted on the control unit, while the control unit is mounted on an elastic device 9 lifting the temperature controller above the heating plate surface. When the cooking vessel is placed on the heating plate, the temperature controller is depressed by the bottom of the cooking vessel to the same level as the heating plate. This makes a solid, direct contact between the temperature transfer device and the bottom of the cooking vessel, and ensures a real-time temperature transfer from the cooking vessel bottom to the control unit.

The table below shows an example of this embodiment, wherein the device is 5 mm long, 20 mm diameter rod made of Aluminum 5052, and lifted 5 mm higher than the heating plate. The control unit, a bi-metal thermostat Y23-16-315-245 made by DongLing, is mounted on a high temperature stainless steel spring, YPmetel NGW002-10-0.15. The plate is 8" with a power rating of 2400 W.

| Temperature in the cooking oil (° C.) | Temperature of the cooking vessel bottom (° C.) | Temperature transferred to the control unit (° C.) | Predetermined temperature limits for control unit (° C.) |
|---|---|---|---|
| 200 | 220 | 185 | |
| 250 | 260 | 245 | 245, Lower temperature limit |
| 300 | 315 | 280 | |
| 320 | 340 | 315 | 315, Upper temperature limit |

For a cooking under the rated power of the heating plate, the upper and lower limits of the control unit are accordingly set to control the bottom temperature of cooking vessel to maintain a desired cooking performance while not exceeding the cooking oil ignition temperature.

In some embodiments, the heating plate is raised by 5-20 mm to achieve better airflow under the plate to further reduce the air temperature around the control unit and the low end of the device.

In some embodiments, the heating plate may have a rated output power between 750W and 3500 W.

In some embodiments, the electric heating conductor may be made of metal, nonmetallic heat conduction material, or mixed metal and nonmetallic material.

In some embodiments, the control unit of the temperature controller may be a thermostat based ON/OFF switch.

In some embodiments, the control unit of the temperature controller may also be a set of relays which controls the output power of the heating plate by multi step adjustment.

In some embodiments, the control unit of the temperature controller can adjust the input voltage of the heating plate by using a silicon-controlled rectifier (SCR) to achieve power adjustments.

A number of preferred embodiments have been fully described above with reference to the drawing figures. The scope of the claims should not be limited by the preferred embodiments and examples but should be given the broadest interpretation consistent with the description as a whole.

What is claimed is:

1. A heating plate comprising:

a heating conductor having a heating surface for receiving a cooking vessel, and a temperature controller;

the temperature controller comprising a control unit configured to adjust an output power of the heating plate and comprising a temperature transfer device configured to contact the cooking vessel on the heating surface of the heating plate and transfer a temperature of the cooking vessel to the control unit;

wherein the temperature transfer device and the control unit are surrounded by a heat insulation layer;

wherein the control unit is configured to compare the temperature of the cooking vessel with an upper temperature limit and a lower temperature limit;

wherein the control unit is configured to reduce the output power of the heating plate when the temperature of the cooking vessel reaches the upper temperature limit, and to increase the output power of the heating plate when the temperature of the cooking vessel reaches the lower temperature limit;

wherein heating plate further comprises a multi-layer heat insulation and reflection pad between the heating conductor and the control unit;

wherein the multi-layer heat insulation and reflection pad is spaced away from and arranged below the heating conductor without contacting the heating conductor so as to reflect radiant heat from the heating conductor toward the cooking vessel and reduce radiant heating of the control unit by the heating conductor, and wherein the control unit is mounted on an elastic member such that the elastic member is configured to raise the temperature transfer device higher than the heating surface when the cooking vessel is not on the heating conductor and to urge contact between the temperature transfer device and the cooking vessel when the cooking vessel contacts the heating surface.

2. The heating plate according to claim 1, wherein the upper temperature limit is determined based on an ignition point of a cooking oil and a relationship between the temperature of the cooking vessel and a temperature of the cooking oil within the cooking vessel; wherein when the temperature of the cooking vessel does not exceed the upper temperature limit, the cooking oil in the cooking vessel does not reach the ignition point.

3. The heating plate according to claim 1, wherein the lower temperature limit is determined based on a minimum temperature for a desired cooking performance and a relationship between the temperature of the cooking vessel and a temperature of a cooking oil within the cooking vessel.

4. The heating plate according to claim 1, wherein a lower end of the temperature transfer device is mounted on a sensing part of the control unit, and the control unit is placed in a cold area away from the heating conductor and the cooking vessel;

wherein an upper end of the temperature transfer device extends above the heating plate when the cooking vessel is not placed on the heating plate and the upper end of the temperature transfer device directly contacts the cooking vessel when the cooking vessel is placed on the heating plate.

5. The heating plate according to claim 1, wherein the control unit is further distanced from the cooking vessel than the heating conductor, when the cooking vessel is placed on the heating plate.

6. The heating plate according to claim 1, wherein the heating plate has a rated output power between 750 W and 3500 W.

7. The heating plate according to claim 1, wherein the control unit is an ON/OFF switch.

8. The heating plate according to claim 1, wherein the control unit is a set of relays that control the output power of the heating plate.

9. The heating plate according to claim 1, wherein the control unit is configured to adjust the output power of the heating plate by adjusting an input voltage of the heating plate.

10. The heating plate according to claim 1, wherein the temperature transfer device is a heat pipe.

11. The heating plate according to claim 1, wherein the multi-layer heat insulation and reflection pad comprises an aluminum disc and a layer of fiberglass.

12. The heating plate according to claim 1, wherein the temperature controller is in a center of the heating conductor.

13. The heating plate according to claim 1, further comprising a metal cap covering the temperature transfer device.

14. The heating plate according to claim 1, wherein the multi-layer heat insulation and reflection pad is arranged parallel with the heating surface of the heating conductor.

15. The heating plate according to claim 1, wherein the multi-layer heat insulation and reflection pad is spaced away from the heating conductor by a distance that is substantially equal to a height of the temperature transfer device.

* * * * *